US005873964A

United States Patent [19]

Kwok

[11] Patent Number: 5,873,964

[45] Date of Patent: Feb. 23, 1999

[54] PROCESS FOR LOFTY BATTINGS

[75] Inventor: Wo Kong Kwok, Hockessin, Del.

[73] Assignee: E. I. du Pont de Nemours and Company, Wilmington, Del.

[21] Appl. No.: 770,197

[22] Filed: Dec. 19, 1996

Related U.S. Application Data

[62] Division of Ser. No. 582,267, Jan. 3, 1996, Pat. No. 5,618, 364, which is a continuation of Ser. No. 542,975, Oct. 13, 1995, abandoned.

[51] Int. Cl.[6] ..... D04H 1/06; D04H 1/58

[52] U.S. Cl. ..... 156/62.8; 156/62.2; 264/122; 264/DIG. 75; 19/163

[58] Field of Search ..... 156/62.2, 62.6, 156/204, 62.8; 264/109, 122, DIG. 75; 19/106 R, 65 A, 163

[56] References Cited

U.S. PATENT DOCUMENTS

| | | | |
|---|---|---|---|
| 3,538,552 | 11/1970 | Foley | 19/163 |
| 3,589,956 | 6/1971 | Kranz et al. . | |
| 4,281,042 | 7/1981 | Pamm . | |
| 4,794,038 | 12/1988 | Marcus . | |
| 4,869,771 | 9/1989 | Le Van . | |
| 4,940,502 | 7/1990 | Marcus . | |
| 4,992,237 | 2/1991 | Donovan et al. . | |
| 5,344,707 | 9/1994 | Snyder . | |
| 5,458,971 | 10/1995 | Hernandez et al. . | |

*Primary Examiner*—Michael W. Ball
*Assistant Examiner*—Sam Chuan Yao

[57] ABSTRACT

Lofty battings are prepared by a process involving carding to make one or more webs of fibers, preferably using a blend of mechanically-crimped filling fibers with bicomponent fibers of helical configuration, and that preferably also contains binder fibers, the fiber orientations preferably being randomized in the web(s) before cross-lapping to build up the batt, and preferably followed by spraying with resin and curing, thus providing a bonded batt in which the loft is improved by the presence of the different crimp configurations and/or randomized orientations that are fixed in the fibers in the bonded batt.

3 Claims, 2 Drawing Sheets

PROCESS FOR LOFTY BATTINGS

CROSS REFERENCE TO RELATED APPLICATION

This is a division of application Ser. No. 08/582,267, filed Jan. 3, 1996 now U.S. Pat. No. 5,618,364 which is a continuation of application Ser. No. 08/542,975, filed Oct. 13, 1995, (DP-6485), being abandoned.

FIELD OF INVENTION

This invention relates to improvements in making lofty bonded battings, such as are used as filling material and insulation.

BACKGROUND ART

Polyester fiberfill filling material (sometimes referred to herein as polyester fiberfill) has become well accepted as a reasonably inexpensive filling and/or insulating material for filled articles, such as cushions and other furnishing materials, including bedding materials, such as mattress pads, quilts, comforters and including duvets, in apparel, such as parkas and other insulated articles of apparel and sleeping bags, because of its bulk filling power, aesthetic qualities and various advantages over other filling materials, so is now manufactured and used in large quantities commercially.

Filling materials are often of staple fiber, sometimes referred to as cut fiber in the case of synthetic fiber, which is first crimped, and is provided in the form of continuous bonded batts (sometimes referred to as battings) for ease of fabrication and conversion of staple into the final filled articles. Traditionally, bonded batts have been made from webs of parallelized (staple) fiber that preferably comprise a blend of binder fibers as well as of regular filling fibers, which can consequently be referred to as load-bearing fibers, such as poly(ethylene terephthalate) homopolymer, often referred to as 2G-T. These webs are made on a garnett or other type of card (carding machine) which straightens and parallelizes the loosened staple fiber to form the desired web of parallelized, crimped fibers. The webs of parallelized fibers are then built up into a batt on a cross-lapper. The batt is usually sprayed with resin and heated to cure the resin and any binder fiber to provide the desired bonded batt. The resin is used to seal the surface(s) of the batt (to prevent leakage) and also to provide bonding. The use of binder fiber intimately blended with the load-bearing fiber throughout the batt has generally been preferred because- such heating to activate the binder material (of the binder material) can provide a "through-bonded" batt. If binder fiber is used, and if a suitable shell fabric can prevent leakage of fibers, then the resin treatment may be omitted, and is in some instances, for example, for some sleeping bags. This simplified explanation is the normal way most bonded batts are now made, because it is not expensive and is adequate for many purposes, especially when dense batts are desired. There has been a limit, however, to the ability to make lofty batts, such as are often desirable for some end-uses, by this normal procedure.

Consequently, some have preferred to use an air-laying process for preparing a lofty batt, which is then bonded. Such an air-laying process does indeed provide a way to overcome the deficiency mentioned of the normal batt-making process that has been used hitherto for making dense batts. Air-laying is, however, more costly and requires different equipment, so it has been desirable to find a less expensive way to overcome the deficiencies of the normal batt-making process without the need for more expensive equipment.

As indicated, the staple fiber is crimped for use as fiberfill. Indeed, the crimp is important in providing the filled articles with bulk and support. Generally, the crimp has been provided mechanically, by stuffer box crimping of a precursor continuous filamentary tow, as has been described in the art, as this is a reasonably inexpensive way of imparting crimp to an otherwise linear synthetic filament.

SUMMARY OF THE INVENTION

The present invention provides a new and improved way to make bonded batts by using essentially the same equipment used previously in the normal batt making process, but also providing an ability to provide loftier (less dense) bonded batts, and thus to overcome the important deficiency mentioned above. Improved loft is provided, according to the invention, by using a blend of mechanically-crimped fibers and of bicomponent fibers of helical configuration (often referred to simply as "helical crimp" or "spiral crimp" in the art and herein) and/or the provision of lofty webs by use of a randomizer in the carding step, otherwise following essentially the normal process of making bonded batts, especially "through-bonded" batts. These aspects may be used separately or in combination.

According to one aspect of the present invention, therefore, I provide a preferred process for preparing a bonded batt, comprising forming a feed blend of mechanically-crimped staple fibers intimately mixed with bicomponent staple fibers having a helical configuration, in amount by weight about 5 to about 30% of the blend, preparing a continuous batt from said feed blend by carding the feed blend to provide a web of parallelized fibers, passing the resulting carded web to a randomizer to provide a web of randomized fibers, cross-lapping one or more webs of randomized fibers to provide a batt, said batt having an upper face and a lower face, advancing said batt through a spray zone, whereby at least one face of the batt is sprayed with resin, in total amount about 5 to about 30% of the weight of the sprayed batt, including the resin, heating the sprayed batt in an oven to cure the resin, and cooling the resulting batt.

According to another aspect, I provide a process for preparing a bonded batt, comprising forming a feed blend of mechanically-crimped staple fibers intimately mixed with bicomponent staple fibers having a helical configuration, in amount by weight about 5 to about 30% of the blend, preparing a continuous batt from said feed blend by carding the feed blend to provide a web of fibers, cross-lapping one or more webs of such fibers to provide a batt, said batt having an upper face and a lower face, advancing said batt through a spray zone, whereby at least one face of the batt is sprayed with resin, in total amount about 5 to about 30% of the weight of the sprayed batt, including the resin, heating the sprayed batt in an oven to cure the resin, and cooling the resulting batt.

Preferably, to provide "through-bonded" batts, such feed blends comprise, intimately mixed therein, binder fibers having binder material that bonds at a temperature that is lower (i.e., has a softening point lower) than any (i.e., lower than the lowest) softening point of the said staple fibers in the feed blend, in amount by weight about 5 to about 30% of the blend, and the sprayed batt is heated in the oven to activate the binder material as well as to cure the resin.

As indicated, in certain instances, resin-spraying may be omitted. So, according to another aspect, I provide a process for preparing a bonded batt, comprising forming a feed blend of mechanically-crimped staple fibers, in amount by weight about 40 to about 90%, intimately mixed with bicomponent staple fibers having a helical configuration, in amount by weight about 5 to about 30%, and with binder fibers having binder material that bonds at a temperature that is lower than the lowest softening point of the said staple fibers in the feed blend, in amount by weight about 5 to about 30%, preparing a continuous batt from said feed blend by carding the feed blend to provide a web of parallelized fibers, passing the resulting carded web to a randomizer to provide a web of randomized fibers, cross-lapping one or more webs of randomized fibers to provide a batt, heating the batt in an oven to-soften the binder material, and cooling the resulting batt.

According to a further aspect, likewise, I provide a process for preparing a bonded batt, comprising. forming a feed blend of mechanically-crimped staple fibers, in amount by weight about 40 to about 90%, intimately mixed with bicomponent staple fibers having a helical configuration, in amount by weight about 5 to about 30%, and with binder fibers having binder material that bonds at a temperature that is lower than the lowest softening point of the said staple fibers in the feed blend, in amount by weight about 5 to about 30%, preparing a continuous batt from said feed blend by carding the feed blend to provide a web of fibers, cross-lapping one or more webs of such fibers to provide a batt, heating the batt in an oven to soften the binder material, and cooling the resulting batt.

As will be seen, merely randomizing the fibers provides an improvement, so, according to this aspect, there is provided a process for preparing a bonded batt, comprising carding feed fibers to provide a web of parallelized fibers, passing the resulting carded web to a randomizer to provide a web of randomized fibers, cross-lapping one or more webs of randomized fibers to provide a batt, said batt having an upper face and a lower face, advancing said batt through a spray zone, whereby at least one face of the batt is sprayed with resin, in total amount about 5 to about 30% of the weight of the sprayed batt, including the resin, heating the sprayed batt in an oven to cure the resin, and cooling the resulting batt.

Further provided is such a process wherein said feed fibers comprise, also, intimately blended therewith in amount by weight about 5 to about 30%, binder fibers having binder material that bonds at a temperature that is lower than the lowest softening point of the said feed fibers, whereby a continuous batt is prepared from the resulting blend by carding the resulting blend to provide a web of parallelized fibers, passing the resulting carded web to a randomizer to provide a web of randomized fibers, cross-lapping one or more webs of randomized fibers to provide a batt, advancing said batt through a spray zone and oven, whereby the sprayed batt is heated in the oven to cure the resin and to soften the binder material, and cooling the resulting batt.

Also provided, likewise, according to another aspect, is a process for preparing a bonded batt, comprising forming a feed blend of mechanically-crimped staple fibers intimately mixed with binder fibers having binder material that bonds at a temperature that is lower than the lowest softening point of the said staple fibers in the feed blend, in amount by weight about 5 to about 30% of the blend, preparing a continuous batt from said feed blend by carding the feed blend to provide a web of parallelized fibers, passing the resulting carded web to a randomizer to provide a web of randomized fibers, cross-lapping one or more webs of randomized fibers to provide a batt, heating the batt in an oven to soften the binder material, and cooling the resulting batt.

"Through-bonded batts" are preferred, such as are made by incorporating binder fibers in amounts of about 5 to about 30% by weight in the feed blend of staple fibers, such as polyester fibers, which are themselves preferred staple fibers, but the invention has also shown advantages with feed fibers that do not include binder-fibers as indicated with fiber "A" in Example 1, hereinafter.

Sheath/core bicomponent fibers are preferred as binder fibers, especially bicomponent binder fibers having a core of polyester homopolymer and a sheath of copolyester that is a binder material, such as are commercially available from Unitika Co., Japan (e.g., sold as MELTY). Preferred proportions of the resin sprayed are about 5 to about 18%, on the inidicated basis, while preferred amounts of binder fiber are about 10% to about 20% (by weight of the feed blend) and correspondingly about 90 to about 80% of the (other) staple fibers, which are preferably polyester, and may be 2G-T, together with any bicomponent fibers of helical configuration.

DETAILED DESCRIPTION OF THE INVENTION

As indicated hereinabove, the process of the invention is essentially similar to the normal process of making bonded batts used conventionally hitherto, but with important exceptions. The improvements in thickness (lowered density) and increased insulation are significant and are shown hereinafter by the comparative data in the Examples.

Thus, the fibers in the carded web are preferably randomized, and preferably by being processed by a randomizer after the carding step and preferably before the cross-lapping step. A randomizer is not an expensive addition to a carding machine. Indeed, nonwoven random cards have been suggested to turn the fibers into the cross-direction (CD), and thus increase the CD:MD (cross-direction:machine direction) of the fibers in webs for flat nonwovens and so randomizing rollers have been available, e.g., from John D. Hollingsworth-on-Wheels in Greenville, S.C., from Ramisch Kleinewefers, Spinnbau Bremen, Germany, and from Ta You Machinery Co. Ltd., in Tao-Yuan, Taiwan. When randomizing rollers have been used in prior processes for making webs for flat non-wovens, the randomized fibers in the webs have subsequently been flattened, for instance by calendering during a calender-bonding process or by compressing the non-woven web after saturation with resin during a saturation-bonding process. Randomizers are not believed to have been used for making lofty bonded baits, nor to overcome the deficiencies of the equipment hitherto normally used for making lofty bonded batts. This is surprising in view of the improvements I have achieved and in view of the simplicity of my change from the normal process.

Figure 1:
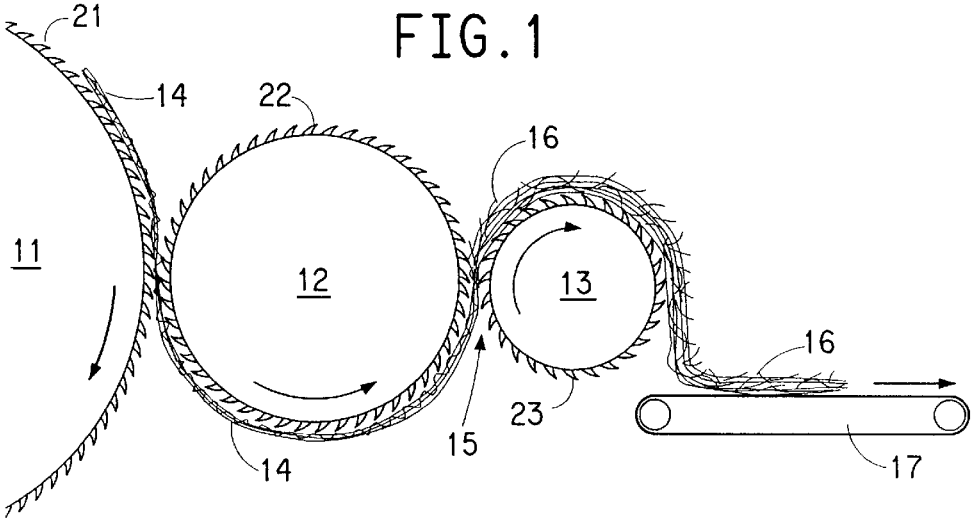
FIG. 1 is a schematic illustration of how a garnett with a randomizer roll may be operated according one aspect of the invention.

This aspect of the invention will now be described with reference to the accompanying drawings, in which like elements are referred to by similar numerals. FIG. 1 illustrates the arrangement of three cylinders (sometimes referred to as rolls) arranged in juxtaposition for a garnetting step according to this aspect of the invention with their axes horizontal, showing from the left a main cylinder 11, a doffer 12, and a randomizer 13, rotating in the directions indicated (main cylinder and randomizer clockwise, with doffer counterclockwise), and with their cylindrical surfaces covered with appropriate card clothing, with teeth oriented as indicated (main cylinder teeth 21 oriented in direction of rotation, but doffer teeth 22 and randomizer teeth 23 opposite to directions of rotation). Thus, a (carded) web 14 is carried by the teeth 21 on main cylinder 11, stripped therefrom by the teeth 22 on doffer 12, and then transferred from the doffer teeth 22 to the randomizer's teeth 23. The randomizer 13 is rotated at a surface speed that is much reduced from the surface speed of the doffer 12, so the parallelized fibers in the web 14 become rearranged in the nip 15 between the doffer 12 and the randomizer 13, and the resulting web 16 carried by the teeth 23 on the randomizer 13 is loftier and contains randomly-oriented fibers, many of which are at significant angles to the machine direction (direction of travel of the web), and can be considered to be vertical or at least have a significant vertical component in relation to a horizontal web. The surface speed of the randomizer 13 should generally be less than ⅔ that of the doffer 12, i.e., doffer surface speed being at least about 1.5X that of randomizer, and often about 2.5X or more, which is generally at the higher end of the range that has been used (for different purposes in making flattened fibrous masses with increased CD:MD ratios for non-wovens). When making lofty bonded batts according to my invention, I do not want to flatten the web, i.e., to remove this vertical component or orientation of the randomized fibers, in contrast to prior processes for making flat non-woven webs that have used a randomizer and then compressed the web to flatten the randomized fibers. This randomized web 16 then drops onto a horizontal conveyor 17, and is transferred to the next stage.

Figure 2:
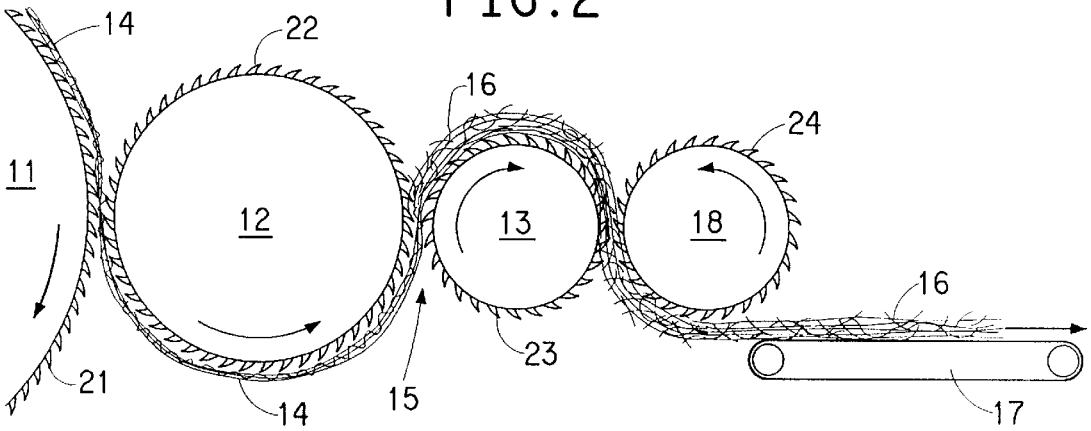
FIG. 2 is a schematic illustration of how a garnett may be operated according to such aspect of the invention with a pair of randomizer rolls.

The garnett illustrated in FIG. 2 is essentially similar to that of FIG. 1, except that two randomizers 13 and 18 are located in series between doffer 12 and conveyor 17, the second randomizer 18 rotating in a counterclockwise direction, with its teeth 24 oriented opposite to the direction of rotation. This alternative is illustrated because machinery with a pair of randomizer rolls has been available commercially in relation to carding flat webs, because it has provided a capability for better control of CD:MD (cross-direction:machine direction) fibers in a flat horizontal web (by varying the relative speeds of the randomizer rolls), but I do not believe that using a second randomizer roll offers significant benefit according to the present invention, which derives benefit from increasing and maintaining vertical components of orientation and providing a lofty web, rather than a flat web. I prefer to operate any second randormizer 18 at a slightly slower surface speed than that of the first randornizer 13.

Figure 3:
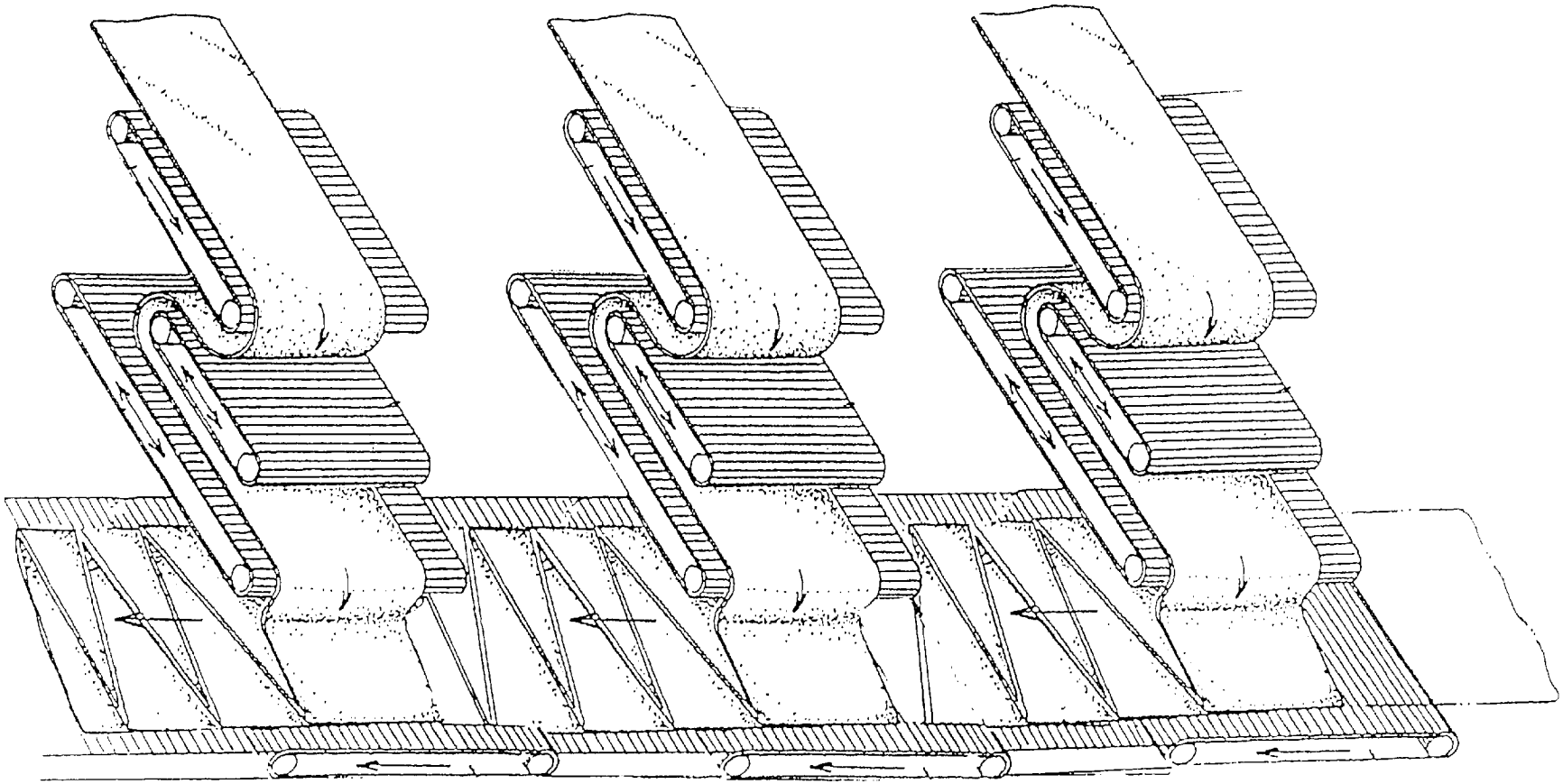
FIG. 3 is a schematic illustration of a cross-lapper operation.

FIG. 3 illustrates a conventional cross-lapper, and further description appears to be unnecessary.

Other features of the invention are mostly conventional, except in regards to the improvement in lofty bonded batts obtained by using a proportion of fibers having helical crimp blended into the feed fiber, as described herein. Hernandez et al. U.S. Pat. No. 5,458,971 and application Ser. No. 08/542,974 filed Oct. 13, 1995 (respectively DP-6320 and DP-6320-C) describe preferred bicomponent fibers having helical configuration and their use as filling fibers. Such fibers, or other fibers-having helical crimp (configuration), are preferably blended into the feed fiber in amount about 5 to about 30% of the feed fiber, especially about 10 to about 20%, by weight. Several bicomponent fibers having a helical configuration are disclosed in the art. This configuration has often been referred to as crimp (because most synthetic fibers obtain their desired non-linear configuration by being mechanically-crimped). In fact, the term "spiral crimp" has been used extensively, although the term "helical" is more correct. The configuration is derived from the eccentric arrangement of the components of the fiber. A side-by-side arrangement is generally preferred.

The invention will be further described in more detail with reference to polyester fiberfill, which is preferred, and to other preferred elements and features, such as preferred binder fibers and helically-crimped fibers, although it will be recognized that other fibers may also be used and there is no reason to limit the invention only to those fibers that are preferred.

Reference may be made to the art, such as referred to herein, for conventional features such as preferred feed fibers (their deniers, cross-sections, blends thereof), and equipment and processing features, including U.S. Pat. No. 5,225,242 and application Ser. No. 08/396,291, filed Feb. 28, 1995 (Frankosky et al. DP-6045 and DP-6045-A), and the art referred to therein. Frankosky et al. application Ser. No. 08/406,355, filed Mar. 17, 1995, now allowed, discloses useful binder materials and fibers. Kerawalla, U.S. Pat. Nos. 5,154,969 and 5,318,650 discloses useful binder fibers and processes. Other disclosures of batts, batt-making and their features include, for example, U.S. Pat. Nos. 5,104,725 (Broaddus), 5,064,703 (Frankosky et al.), 5,023,131 (Kwok), 4,999,232 (LeVan), 4,869,771 (LeVan), 4,818,599 (Marcus), 4,304,817 (Frankosky), and 4,281,042 (Pamm), and the references disclosed therein.

The invention is further illustrated in the following Examples; all parts and percentages are by weight unless otherwise indicated. The garnett was supplied by Ta You Machinery Co. Ltd., Tao-Yuan, Taiwan ROC. The cross-lapper used was supplied by Asselin SA, Elbeuf, France. Randomizer rolls were supplied by Ta You Machinery Co. Ltd., and by John D. Hollingsworth on Wheels, Greenville, S.C. CLO ratings are conventional and described, e.g., by Hwang in U.S. Pat. No. 4,514,455.

EXAMPLE 1

Staple fiber and blends as indicated hereinafter in the following Table 1 and explanatory notes were processed into bonded battings by the following procedures, with and without using a randomizer roll, for comparison, and otherwise following essentially the procedure described in Example 5 of copending application Ser. No. 08/542,974 (DP-6320-C) filed Oct. 13, 1995 by Hernandez et al. In other words, both for making battings according to the invention (using a randomizer roll and/or bicomponent fiber of helical configuration) and for comparisons, the blends were processed on a garnett and then cross-lapped and sprayed with half the indicated amount of an acrylic resin on the top side and carried by conveyor to the first path of a three-path oven to cure the resin and activate the binder fiber at 150° C.; at the exit of the first path, the batting was turned upside-down and the-other side of the batting was sprayed with the other half of the same acrylic resin to make up the total resin pickup; the batting was carried by another conveyor to the second path of the oven and For making battings according to the randomizer aspect of the invention during the garnetting process, the web that was removed from the main cylinder of the garnett by the doffer was delivered from the doffer to a randomizer roll, as shown in FIG. 1 of the accompanying drawings, at a speed 2.6X the surface speed of the randomizer roll . Because the speed of the doffer was so much faster than the speed of the randomizer, the orientation of the fibers in the web was rearranged from a flat parallelized web to a loftier, thicker web with randomized fibers, several being oriented in a vertical direction (at right angles to both the machine and cross-directions, referred to generally as MD and CD). This loftier web (loftier than the comparison webs made by garnetting without any randomization) was then cross-lapped (to build up basis weight) and sprayed with resin, and heated in similar manner to the comparison webs.

The improvements in thickness and insulating properties achieved by use of the invention can be seen from the data given in Table 1. It will be noted that the improvements obtained by the invention were step-wise, improvements being achieved by using either the randomizer (Rand), or by incorporating fiber of helical crimp in minor amount in a blend of feed fiber; as indicated under BiC (for BiComponent), and the best results were obtained by using both aspects.

TABLE 1

| | Staple | BiC | Resin | BW | Thickness | | CLO | CLO/ |
|---|---|---|---|---|---|---|---|---|
| Rand | Type | % | % | (oz) | in | in/oz/yd$^2$ | CLO | oz/yd$^2$ |
| No | A | 0 | 12.3 | 4.82 | 0.89 | 0.18 | 2.58 | 0.54 |
| Yes | | 0 | 12.1 | 4.51 | 0.87 | 0.19 | 2.55 | 0.57 |
| Yes | | 15 | 9.8 | 4.39 | 0.89 | 0.20 | 2.62 | 0.60 |
| No | B | 0 | 20.9 | 4.65 | 0.71 | 0.15 | 2.63 | 0.57 |
| Yes | | 0 | 26.2 | 4.95 | 1.02 | 0.21 | 2.99 | 0.60 |
| Yes | | 15 | 25.0 | 4.66 | 1.04 | 0.22 | 2.89 | 0.62 |

EXAMPLE 2

Staple fiber blends as indicated in Table 2 were processed into bonded batts according to the invention following essentially similar procedures as described in Example 1, except that the web was passed from the doffer to the first of a pair-of randomizer rolls as illustrated in FIG. 2 herein, and then to the second randomizer roll, which was operated at a slightly slower speed. Details and measurements of properties are given in Table 2.

TABLE 2

| | Staple | BiC | Resin | BW | Thickness | | CLO | CLO/ |
|---|---|---|---|---|---|---|---|---|
| Rand | Type | % | % | (oz) | in | in/oz/yd$^2$ | CLO | oz/yd$^2$ |
| Yes | C | 0 | 11.0 | 3.17 | 0.48 | 0.15 | 1.75 | 0.55 |
| Yes | | 15 | 14.1 | 2.86 | 0.52 | 0.18 | 1.70 | 0.59 |
| Yes | | 30 | 10.1 | 2.92 | 0.56 | 0.19 | 2.06 | 0.71 |

Explanatory Notes

The following abbreviations were used in the Examples:

"Rand" indicates whether a randomizer was used, or the experiment was a comparison performed without randomizing, but under otherwise similar conditions;

"BIC" indicates the amount of bicomponent fiber, which was the 9 dpf, 3 inch, slickened, 3-void, helical crimp bicomponent polyester fiber of Example 1 of U.S. Pat. No. 5,458,971;

"BW" indicates the "Batting Weight" of the batt, i.e., after spraying on resin, the total percentage amount sprayed being indicated under "Resin";

"Thickness" and "CLO" are both given in absolute values and after being normalized to equivalent batting weights per unit area;

"Staple" fibers and blends are available commercially, as follows:

A—slickened 5.5 dpf, 3-inch cut length (7.5 cm), 7-hole

B—55% slickened 3.6 dpf, 2.5-inch cut length (6.3 cm), hollow 27% slickened 1.65 dpf, 2.5-inch cut length (6.3 cm) 18% 4 dpf, 2.5-inch cut length (6.3 cm) MELTY 4080

C—55% slickened 1.65 dpf, 2-inch cut length (5 cm) 27% 1.65 dpf, 2-inch cut length (5 cm) 18% 4 dpf, 2-inch cut length (9 cm) MELTY 4080

The regular fiberfill above, i.e., other than binder fiber, was 2G-T polyester of solid cross-section, unless otherwise indicated; MELTY 4080 is a sheath/core binder fiber, referred to in the art, and commercially available from Unitika Co., Japan; the fibers used were all of round periphery and none were slickened unless indicated.

I claim:

1. A process for preparing a bonded batt, comprising forming a feed blend of mechanically-crimped staple fiberfill fibers intimately mixed with bicomponent staple fiberfill fibers that have a helical configuration and are other than binder fibers, in amount by weight about 5 to about 30% of the blend, preparing a continuous batt from said feed blend by carding the feed blend to provide a web of fibers, cross-lapping one or more webs of such fibers to provide a batt, said batt having an upper face and a lower face, advancing said batt through a spray zone, whereby at least one face of the batt is sprayed with resin, in total amount about 5 to about 30% of the weight of the sprayed batt, including the resin, heating the sprayed batt in an oven to cure the resin, and cooling the resulting batt.

2. A process according to claim 1, wherein said feed blend further comprises, intimately mixed therein, binder fibers having binder material that bonds at a temperature that is lower than any softening point of the said staple fiberfill fibers in the feed blend, in amount by weight about 5 to about 30% of the blend, and wherein the sprayed batt is heated in the; oven to cure the resin and to soften the binder material.

3. A process for preparing a bonded batt, comprising forming a feed blend of mechanically-crimped staple fiberfill fibers, in amount by weight about 40 to about 90%, intimately mixed with bicomponent staple fiberfill fibers that have a helical configuration and-are other than binder fibers, in amount by weight about 5 to about 30%, and with binder fibers having binder material that bonds at a temperature that is lower than any softening point of the said staple fiberfill fibers in the feed blend, in amount by weight about 5 to about 30%, preparing a continuous batt from said feed blend by carding the feed blend to provide a web of fibers, cross-lapping one or more webs of such fibers to provide a batt, heating the batt in an oven to soften the binder material, and cooling the resulting batt.

* * * * *